US005778281A

United States Patent [19]

Handa

[11] Patent Number: 5,778,281

[45] Date of Patent: Jul. 7, 1998

[54] TRANSFER APPARATUS

[75] Inventor: Osamu Handa, Ebina, Japan

[73] Assignee: Fuji Xerox Co., Ltd., Tokyo, Japan

[21] Appl. No.: 780,296

[22] Filed: Jan. 8, 1997

[30] Foreign Application Priority Data

Jan. 22, 1996 [JP] Japan ..... 8-027324

[51] Int. Cl.[6] ..... G03G 15/16

[52] U.S. Cl. ..... 399/101; 399/313

[58] Field of Search ..... 399/101, 297, 399/302, 308, 313, 159

[56] References Cited

U.S. PATENT DOCUMENTS

| | | | |
|---|---|---|---|
| 4,382,673 | 5/1983 | Nakajima et al. | 399/101 |
| 4,588,279 | 5/1986 | Fukuchi et al. | 399/308 |
| 4,931,839 | 6/1990 | Tompkins et al. | 399/101 X |
| 4,998,143 | 3/1991 | Kumasaka et al. | 399/101 |
| 5,233,394 | 8/1993 | Fujita et al. | 399/101 |
| 5,438,398 | 8/1995 | Tanigawa et al. | 399/302 |
| 5,468,584 | 11/1995 | Go et al. | 399/159 X |
| 5,530,532 | 6/1996 | Iino et al. | 399/308 X |
| 5,557,384 | 9/1996 | Takano et al. | 399/313 |
| 5,579,096 | 11/1996 | Saito et al. | 399/101 |

FOREIGN PATENT DOCUMENTS

| | | |
|---|---|---|
| 56-154773 | 11/1981 | Japan . |
| 4-027988 | 1/1992 | Japan . |
| A-6-118805 | 4/1994 | Japan . |
| A-6-149097 | 5/1994 | Japan . |
| 7-121038 | 5/1995 | Japan . |

*Primary Examiner*—Arthur T. Grimley
*Assistant Examiner*—Sophia S. Chen
*Attorney, Agent, or Firm*—Oliff & Berridge, PLC

[57] ABSTRACT

A transfer apparatus for electrostatically transferring a toner image of a given polarity supported on an image support to a recording medium includes a transfer roll and a cleaning member. The transfer roll comes in rolling contact with the image support in synchronization therewith and has a transfer electric field of an opposite polarity to toner formed in a gap between the transfer roll and the image support. The cleaning member abuts the transfer roll to remove residues on the transfer roll. A charged property of a contact surface portion between the cleaning member and the transfer roll is set so that a charge polarity on a surface of the transfer roll produced as the cleaning member abuts the transfer roll becomes the same as a toner polarity on the image support.

20 Claims, 5 Drawing Sheets

TRANSFER APPARATUS

BACKGROUND OF THE INVENTION

This invention relates to a transfer apparatus used with an image formation system such as an electrophotographic copier or a laser printer for transferring a toner image formed on an image support to a recording medium and in particular to an improvement in a transfer apparatus of the type comprising a transfer roll coming in rolling contact with an image support for transferring a toner image on the image support electrostatically to a recording medium.

Known as a color image formation system such as an electrophotographic copier is a system for once executing primary transfer of a toner image formed on an image support such as a photosensitive body onto an intermediate transfer body other than transfer paper and then executing secondary transfer of the toner image on the intermediate transfer body onto transfer paper, thereby providing a copy image.

The system of this type is preferred in that it can prevent occurrence of a multiple transfer failure or a color registration shift caused by many sources such as the paper holding state, paper thickness or firmness, and paper surface property as compared with a so-called transfer drum system for winding paper around a drum and holding the paper thereon for multiply transferring an image to the paper.

Usually used as a secondary transfer apparatus used with such a color image formation system with an intermediate transfer body is, for example, a transfer apparatus for bringing a transfer roll into rolling contact with an intermediate transfer body like a belt, disposing a backup roll on the rear side of the intermediate transfer body corresponding to the transfer roll, and applying a voltage of an opposite polarity to toner to the transfer roll, thereby electrostatically transferring a toner image on the intermediate transfer body to transfer paper.

However, the transfer apparatus has the following technical problems:

If the transfer roll comes in contact with the intermediate transfer body in an area where no transfer paper exists, toner adheres to the transfer body and will dirty the rear face of the next sheet of transfer paper.

Particularly, when a paper jam occurs or small transfer paper as compared with an original image is used, rear face dirt of transfer paper occurs noticeably.

To solve such a technical problem, it is considered that the adhesion force of toner to the transfer roll is weakened, for example.

Available as a method for weakening the adhesion force of toner to the transfer roll is a method for making transfer roll surface roughness larger than the toner particle diameter and coating the surface of the transfer roll with fluorine, etc., in spots for making toner hard to adhere to the transfer roll, for example, as shown in the Unexamined Japanese Patent Application Publication No. Hei. 6-149097.

However, this method can decrease the mechanical adhesion force of toner to the transfer roll, but cannot decrease the electrostatic adhesion force and cannot completely prevent adhesion of toner to the transfer roll.

Then, hitherto, an art has been already provided for abutting a cleaning blade against the surface of a transfer roll for forcibly removing toner adhering to the transfer roll surface and other deposits thereon, as shown in the Unexamined Japanese Patent Application Publication No. Hei. 6-118805.

In the art of this type, the toner adhering to the transfer roll surface can be removed reliably. To do this, however, the cleaning blade must be abutted against the transfer roll surface by a large force. Thus, the load on the transfer roll increases and the rotation speed of the transfer roll does not match that of an intermediate transfer body, causing image extension, image deformation, a registration shift, etc., to occur, or the load is so large that the transfer roll does not rotate, causing a paper jam to occur.

To decrease the adhesion force of toner to the transfer roll, it is also possible to remove electricity of toner by a corona charger, etc., before cleaning. However, if a large amount of toner adheres to the transfer roll as toner adheres to the transfer roll when a paper jam occurs as described above, electricity of toner in the vicinity of the transfer roll surface cannot be removed and still the adhesion force of toner to the transfer roll cannot reliably be weakened.

Such technical problems arise not only in the transfer apparatus of the image formation system using an intermediate body, but also in a transfer apparatus comprising a transfer roll and a cleaning member such as a cleaning blade, used as a transfer apparatus of an image formation system for transferring a toner image from an image support such as a photosensitive drum directly to transfer paper without using any intermediate transfer body, for example.

SUMMARY OF THE INVENTION

It is therefore an object of the invention to provide a transfer apparatus capable of weakening the adhesion force of toner to a transfer roll and removing toner adhering to the transfer roll easily and reliably without imposing such a load interfering with rotation of the transfer roll.

To that end, according to the invention, as shown in FIG. 1, there is provided a transfer apparatus for electrostatically transferring a toner image T of a given polarity supported on an image support 1 to a recording medium 2, the apparatus comprising a transfer roll 3 coming in rolling contact with the image support 1 in synchronization therewith and having a transfer electric field of an opposite polarity to toner formed in a gap between the transfer roll 3 and the image support 1, and a cleaning member 4 abutting the transfer roll 3 for removing residues on the transfer roll 3, characterized in that a charge property of a contact surface portion between the cleaning member 4 and the transfer roll 3 is set so that a charge polarity on a surface of the transfer roll 3 produced as the cleaning member 4 abuts the transfer roll 3 becomes the same as a toner polarity on the image support 1.

In another aspect of the invention, as shown in FIG. 1, the charge property of the contact surface portion between the image support 1 and the transfer roll 3 is set so that the charge polarity on the surface of the transfer roll 3 produced as the image support 1 abuts the transfer roll 3 becomes the same as the toner polarity on the image support 1 in the type wherein the transfer roll 3 and the cleaning member are provided.

In such technical means, the image support 1 includes all members for supporting the toner image T. For example, in the image formation system having an intermediate transfer body, the image support 1 refers to the intermediate transfer body; in the image formation system having no intermediate transfer body, the image support 1 refers to the image support itself such as the photosensitive drum.

The polarity of the toner image T supported on the image support 1 may be positive or negative.

The transfer roll 3 may be changed in design appropriately if it can generate a transfer electric field between the transfer roll 3 and the image support 1 when an electrostatic transfer voltage is applied.

For example, if a flexible belt is used as an intermediate transfer body, normally it is necessary to dispose a conductive or semiconductive backup roll on the rear of the intermediate transfer belt. However, if a drum is used as an intermediate transfer body, the transfer roll may be brought into direct contact with the intermediate transfer drum, photosensitive drum, etc., like a normal photosensitive drum, etc.

Further, a cleaning blade, a cleaning brush, etc., may be selected appropriately as the cleaning member 4 if it abuts the transfer roll 3.

Further, the charge property between the transfer roll 3 and the cleaning member 4 or between the transfer roll 3 and the image support 1 may be set at least for the material of the contact surface portion therebetween.

Here, for example, if the charge property between the transfer roll 3 and the cleaning member 4 is set to a predetermined property, it is not preferred that the transfer roll 3 is charged to an opposite polarity to the toner polarity in relation to other members coming in contact with the transfer roll 3. At least the transfer roll 3 is prevented from being charged in relation to other contact members (for example, the same material is used) or preferably the transfer roll 3 is charged to the same polarity as the toner polarity in relation to other contact members.

Therefore, in the best form of the invention, as shown in FIG. 1, the charge property between the transfer roll 3 and the cleaning member 4 and that between the transfer roll 3 and the image support 1 are set so that both the charge polarity on the surface of the transfer roll 3 produced as the cleaning member 4 abuts the transfer roll 3 and the charge polarity on the surface of the transfer roll 3 produced as the image support 1 abuts the transfer roll 3 become the same as the toner polarity on the image support 1 in the type wherein the transfer roll 3 and the cleaning member 4 are provided.

In the form, particularly when the toner image T has a negative polarity, the best result can be produced by the transfer apparatus wherein the surface of the transfer roll 3 is made of polytetra fluoroethylene, the surface of the cleaning member 4 is made of polyurethane, and the surface of the image support 1 is made of polyimide.

According to the technical means as described above, the charge property of the contact surface portion between the cleaning member 4 (image support 1) and the transfer roll 3 is set so that the charge polarity on the surface of the transfer roll 3 produced as the cleaning member 4 (image support 1) abuts the transfer roll 3 becomes the same as the toner polarity on the image support 1.

At this time, the toner does not electrostatically adheres to the transfer roll 3. Thus, even if the toner adheres to the transfer roll 3, it is removed by a weak force.

DETAILED DESCRIPTION OF THE PREFERRED EMBODIMENTS

Referring now to the accompanying drawings, there are shown preferred embodiments of the invention.

Embodiment 1

Figure 1:
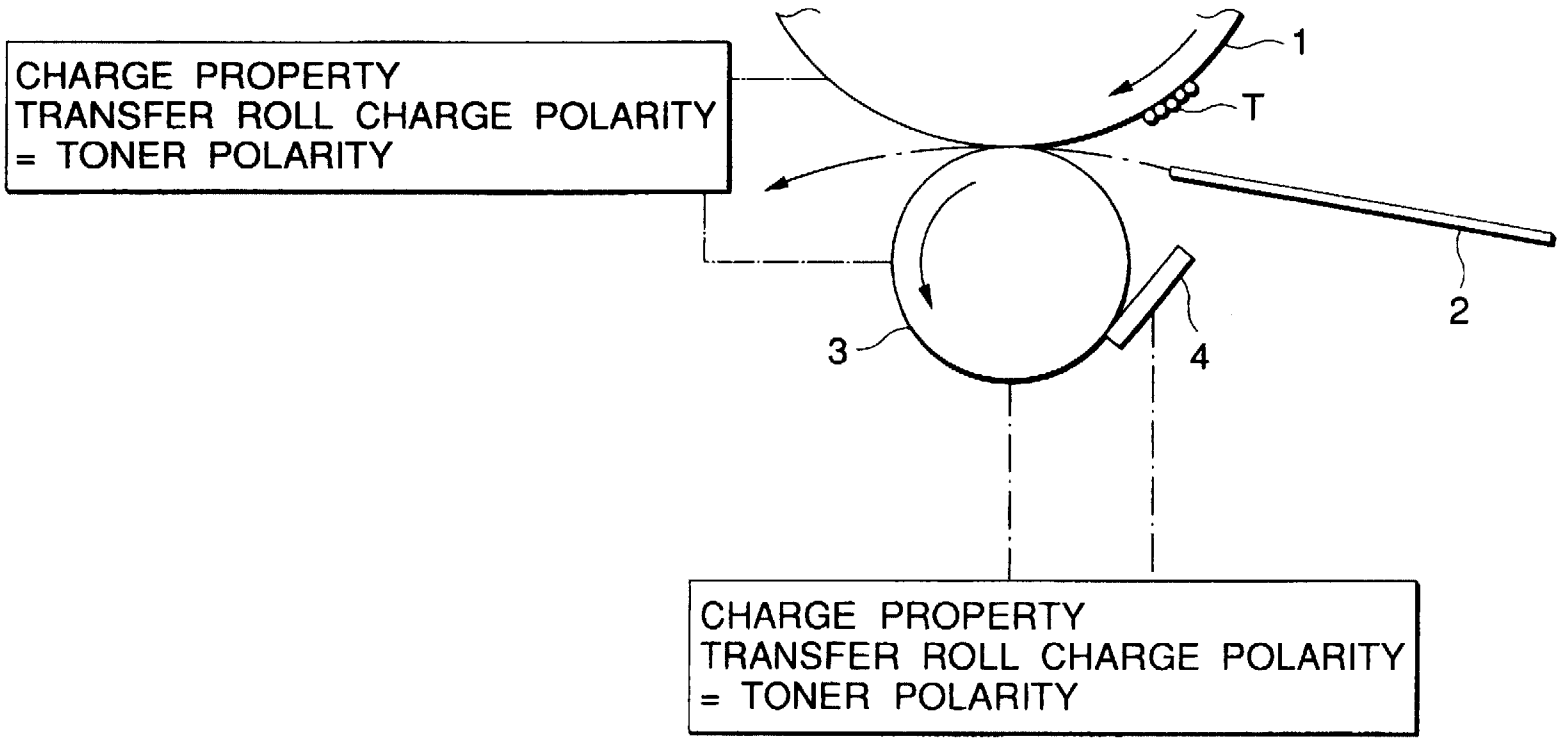
FIG. 1 is an illustration to show the configuration of a transfer apparatus according to the invention.
Figure 2:
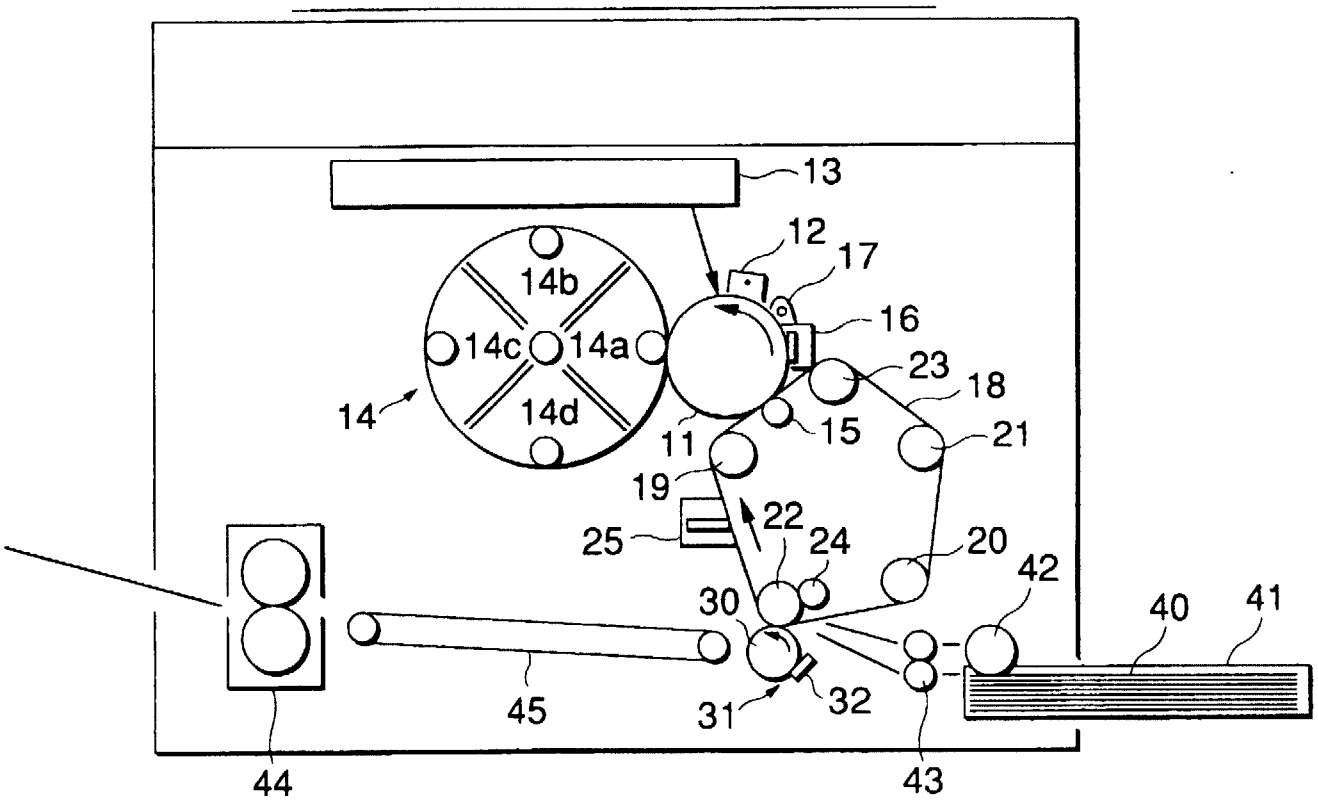
FIG. 2 is an illustration to show a first embodiment of applying the invention to a color image formation system using an intermediate transfer body.

FIG. 2 shows a first embodiment of applying the invention to a color image formation system using an intermediate transfer body.

In the figure, numeral 11 is a photosensitive drum rotating in the direction indicated by the arrow in the figure. This photosensitive drum 11 is surrounded by a charger 12 for charging the photosensitive drum 11, an exposure unit 13 for exposing electrostatic latent images of color components on the charged photosensitive drum 11, a developing unit 14 (specifically, 14*a*–14*d*) for visualizing color component toners formed on the photosensitive drum 11 in predetermined color toners (in the embodiment, black, yellow, magenta, and cyan color toners), a transfer roll 15 for primary transfer for transferring each color toner image on the photosensitive drum 11 to an intermediate transfer belt 18 described later, a cleaner 16 for removing remaining toner on the photosensitive drum 11, and an electricity removal lamp 17 for removing remaining charges on the photosensitive drum 11, whereby a monochrome or color toner image is formed on the intermediate transfer belt 18 by a known electrophotographic process.

Numeral 18 is the intermediate transfer belt placed so as to abut the surface of the photosensitive drum 11 at a primary transfer position; it is placed on a drive roll 19, a walk correction roll 20, a tension roll 21 for giving a tension, a backup roll 22 for secondary transfer, and a driven roll 23. The primary transfer roll 15 is disposed on the rear face of the intermediate transfer belt 18 corresponding to the primary transfer position and a voltage of an opposite polarity to toner is applied to the primary transfer roll 15.

Figure 3:
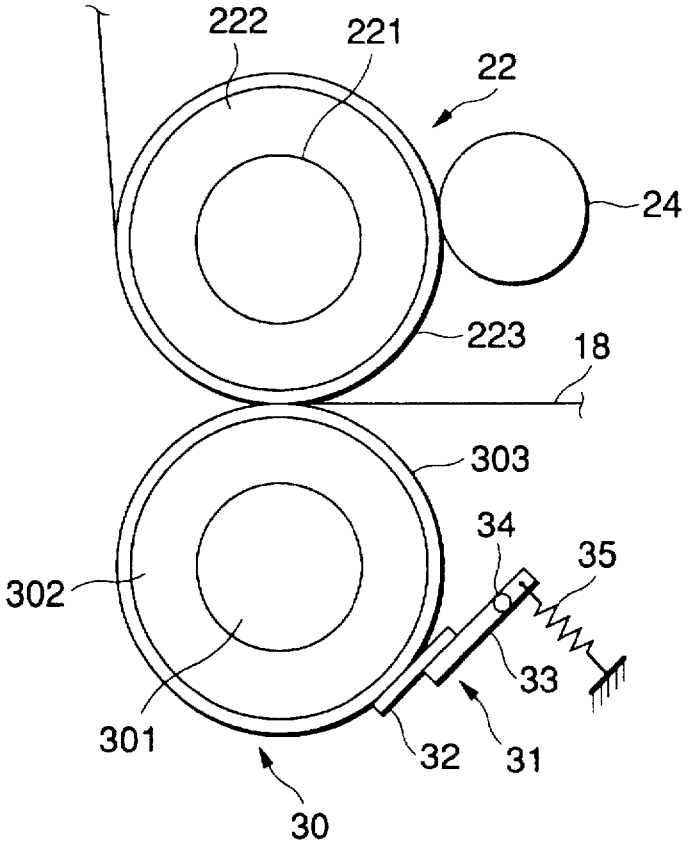
FIG. 3 is an illustration to show a secondary transfer apparatus used in the first embodiment of the invention.

Further, in the embodiment, the backup roll 22 for secondary transfer comprises an insulating rubber layer 222 made of Si (silicon), EPDM (diene rubber), etc., 2–5 mm thick formed on a metal mandrel 221 and covered with a semiconductive tube 223, and a contact roll 24 is disposed so as to come in contact with the semiconductive tube 223, as shown in FIG. 3.

On the other hand, a secondary transfer roll 30 is disposed on the surface side of the intermediate transfer belt 18 corresponding to the backup roll 22 so that it can come in rolling contact with the intermediate transfer belt 18, and is grounded.

A bias voltage of the same polarity as toner (in the embodiment, negative polarity) is applied to the contact roll 24, and an electric field of an opposite polarity to toner for electrostatically attracting toner to the intermediate transfer belt 18 is formed by an electric current flowing into the grounded secondary transfer roll 30 from the contact roll 24 via the semiconductive tube 223 of the secondary transfer backup roll 22.

Numeral 25 is a belt cleaner for removing remaining toner on the intermediate transfer belt 18.

Further, numeral 41 is a paper feed cassette for storing transfer paper 40, numeral 42 is a feed roll for feeding the transfer paper 40 in the paper feed cassette 41, numeral 43 is a registration roll for controlling the timing at which transfer paper 40 is fed into a secondary transfer position, numeral 44 is a fuser for fixing an unfixed toner image on transfer paper 40, and numeral 45 is a conveyor belt for transporting the transfer paper 40 passing through the secondary transfer position to the fuser 45.

In the embodiment, the intermediate transfer belt 18 is made of a material comprising a resistance control agent of CB (carbon black), etc., mixed into PI (polyimide), PVdF (polyvinylidene fluoride), PC (polycarbonate) at volume resistivity $10^7$–$10^{14}$ Ω cm. If the volume resistivity is lower than $10^8$ Ω cm, charges given to the rear face of the intermediate transfer belt 18 at the primary transfer position spread through resistance of the intermediate transfer belt 18 to the outside of a transfer nip, thus toner is transferred from the photosensitive drum 11 to the intermediate transfer belt 18 before the photosensitive drum 11 and the intermediate transfer belt 18 come in contact with each other. Therefore, the toner is scattered heavily and a good image cannot be provided. If the volume resistivity is higher than $10^{12}$ Ω cm, the intermediate transfer belt 18 is charged and an electricity remover is required. Therefore, it is desirable that the material of the intermediate transfer belt 18 has the volume resistivity $10^8$–$10^{12}$ Ω cm. If the material of the intermediate transfer belt 18 is 50 μm or less thick, the mechanical strength is insufficient and the belt is broken, ripped, etc., thus the material of the intermediate transfer belt 18 is made more than 50 μm thick.

In the embodiment, the secondary transfer roll 30 uses a roll of outer diameter 28 mm comprising a conductive elastic layer 302 made of EPDM, Si (silicone rubber), etc., containing a conductive material of CB (carbon black), etc., formed on a metal mandrel 301 and covered with a coat layer 303 made of PA (polyamide), Si (silicone resin, silicone rubber), and polytetra fluoroethylene (trade name: Teflon), as shown in FIG. 3.

Further, the secondary transfer roll 30 is additionally provided with a transfer roll cleaner 31 having a cleaning blade 32 abutting the transfer roll 30, as shown in FIG. 3.

The cleaning blade 32 is made of PU (polyurethane) 1–2 mm thick, 20 mm wide, and 320 mm long in the length direction and is bonded to a support member 33 pivotable about a rotation shaft 34. The support member 33 is energized in a predetermined direction by a spring 35 so as to press the cleaning blade 32 against the transfer roll 30.

The press force is a load of 0.5–3.0 g per unit length in the length direction of the cleaning blade 32. If it is a load smaller than 0.5 g/cm, when the transfer roll 30 rotates, the cleaning blade 32 may be detached from the transfer roll 30, causing a partial cleaning failure. Thus, the press force cannot be used. If it is a load larger than 3.0 g/cm, the cleaning blade 32 "strikes against the belly" of the transfer roll 30, and a cleaning failure also occurs.

Figure 4:
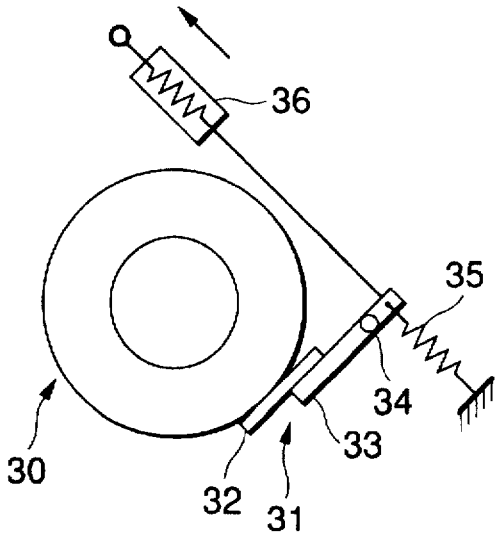
FIG. 4 is an illustration to show a press force measurement method of a cleaning blade in the first embodiment of the invention.

As the press force measurement method, as shown in FIG. 4, a push-pull gage 36 for pulling toward a direction opposite to the energization direction of the spring 35 is attached, a load when the cleaning blade 32 is detached from the transfer roll 30 is measured, and conversion is made in the ratio between the distance from the rotation shaft 34 to the attachment point of the push-pull gage 36 and the distance from the rotation shaft 34 to the contact point of the cleaning blade 32 with the secondary transfer roll 30.

Next, the operation of the color image formation system according to the invention will be discussed.

The color image formation system forms an image as follows:

The photosensitive drum 11 starts to rotate in response to a copy operation start signal and is charged to a predetermined potential by the charger 12 and a latent image is formed by the exposure unit 13. As the latent image formed on the photosensitive drum 11 moves, one of the developing devices 14*a*–14*d* approaches the photosensitive drum 11 and develops the latent image in a predetermined color toner.

As the developing operation is performed, the intermediate transfer belt 18 also moves at substantially the same speed as the peripheral speed of the photosensitive drum 11 and a toner image moving to the primary transfer position at which the photosensitive drum 11 abuts the intermediate transfer belt 18 is transferred to the intermediate transfer belt 18 by the action of an electric field produced by applying a voltage of an opposite polarity to toner to the primary transfer roll 15 as the primary transfer.

On the other hand, the remaining toner on the photosensitive drum 11 is removed by the cleaner 18 and electricity of the photosensitive drum 11 is removed by the electricity removal lamp 17 for the next image formation operation.

This process is repeated, thereby providing a full color toner image multiply transferred onto the intermediate transfer belt 18.

During the primary transfer operation, the secondary transfer roll 30 and the belt cleaner 25 are placed away from the intermediate transfer belt 18 so as not to disturb the toner image on the intermediate transfer belt 18 and transfer paper 40 fed by the feed roller 42 also stands by in the vicinity of the registration roller 43.

As the toner image subjected to the primary transfer is moved to the secondary transfer position, the transfer paper 40 is sent by the registration roller 43 to the secondary transfer position and the secondary transfer roll 30 abuts the intermediate transfer belt 18.

When the toner image subjected to the primary transfer arrives at the secondary transfer position, the toner image on the intermediate transfer belt 18 is electrostatically transferred to the transfer paper sent to the secondary transfer position by the action of the electric field formed by an electric current flowing into the grounded secondary transfer roll 30 via the semiconductive tube 223 of the secondary transfer backup roll 22 from the contact roll 24 to which a bias voltage of the same polarity as the toner is applied.

After this, the transfer paper 40 to which the secondary transfer has been executed is attracted to the conveyor belt 45 and is transported to the fuser 44, which then fixes the transfer paper. On the other hand, the remaining toner on the intermediate transfer belt 18 is removed by the belt cleaner 25 for the next image formation operation.

If the secondary transfer roll 30 abuts the face of the intermediate transfer belt 18 other than the transfer paper 40, a part of the remaining toner on the intermediate transfer belt 18 adheres to the secondary transfer roll 30 and the adhering toner is scraped off by the cleaning blade 32 of the transfer roll cleaner 31.

The cleaning performance of the transfer roll cleaner 31 according to the embodiment is examined.

In an evaluation method of the cleaning performance, first a toner image of the same size as transfer paper 40 of the maximum size is formed on the intermediate transfer belt 18 by the above-described process and is transferred to transfer paper 40 of a smaller size than the toner image, next transferred to the transfer paper 40 of the maximum size in the above-mentioned process, and whether or not toner adheres to the rear face of the transfer paper 40 (the face coming in contact with the secondary transfer roll 30) is checked.

That is, the second sheet of transfer paper 40 is checked to see if the toner image adhering to the secondary transfer roll 30 in the portion jutting out from the first sheet of transfer paper 40 at the transfer time thereto is removed.

This evaluation is executed while the load for pressing the cleaning blade 32 against the secondary transfer roll 30 is increased. The cleaning performance is evaluated based on the rotation torque of the secondary transfer roll 30 when the minimum load under which the rear face of the second sheeet of transfer paper is dirtied is imposed.

Figure 5:
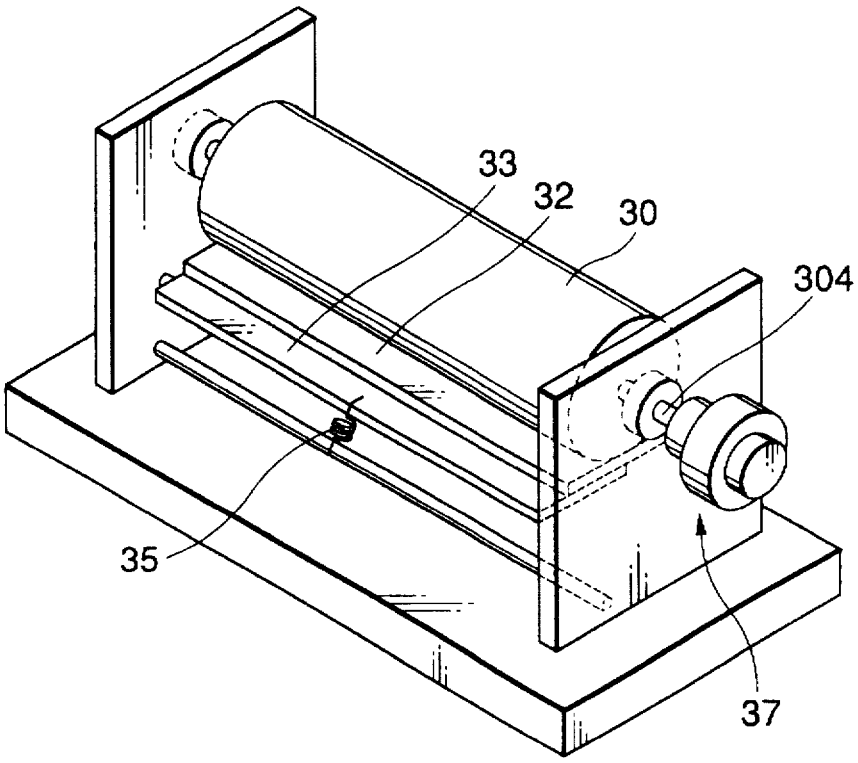
FIG. 5 is an illustration to show a rotation torque measurement method of a transfer roll in the first embodiment of the invention.

In the embodiment, to measure the rotation torque, for example, as shown in FIG. 5, a torque gage 37 is attached to a rotation shaft 304 of the secondary transfer roll 30 and a static torque is measured under the condition that the cleaning blade 32 is pressed against the secondary transfer roll 30. When the rotation torque of the secondary transfer roll 30 exceeds 0.8 kgcm, the secondary transfer roll 30 is not driven, so that the cleaning blade 32 cannot be used under the load corresponding to the rotation torque.

Figure 6:
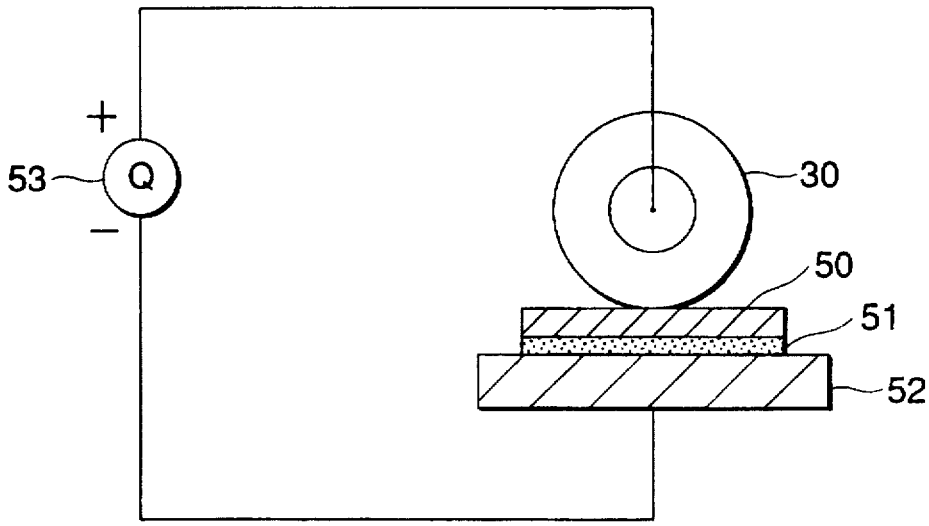
FIG. 6 is an illustration to show a charge property measurement method of a target member in the first embodiment of the invention.

The charge property is evaluated as follows:

First, as shown in FIG. 6, the intermediate transfer belt 18 and the cleaning blade 32 are processed to a 10 cm×10 cm sheet specimen 50 and conductive paint 51 is applied to one face of the sheet specimen 50. The sheet specimen 50 is placed on a metal plate 52 with the conductive paint 51 application face down and the secondary transfer roll 30 is placed on the sheet specimen 50. The secondary transfer roll 30 is connected to a positive terminal of an electrometer 53 (in the embodiment, a Keithley Instruments Inc. 616) and the metal plate 52 is connected to a negative terminal of the electrometer 53, then the secondary transfer roll 30 is rolled on the sheet specimen 50 several to ten times.

At this time, if the charges accumulated in the electrometer 53 are negative, the charge property of the secondary transfer roll 30 for the sheet specimen is assumed to be negative; if the charges accumulated in the electrometer 53 are positive, the charge property of the secondary transfer roll 30 for the sheet specimen is assumed to be positive.

Table 1 lists the charge property evaluation results among materials (in the embodiment, PI (polyimide), PU (polyurethane), PVdF (polyvinylidene fluoride), Si (silicon), polytetra fluoroethylene (Teflon (trade name)), and PA (polyamide).

The charge property evaluated by this method matches that determined from a so-called frictional electrification series.

TABLE 1

| | Negative terminal | | | | | |
|---|---|---|---|---|---|---|
| Positive terminal | PI | PU | PVdF | Si | Teflon | PA |
| PI | | | | | | |
| PU | | | | | | |
| PVdF | − | − | | | | |
| Si | − | + | + | | | |
| Teflon | − | − | + | − | | |
| PA | − | + | + | + | + | |

(Teflon is a trade name.)

According to Table 1, it is understood that the charge property among the materials is as follows:

(Positive terminal) PI<PA<Si<PU<Teflon<PVdF (negative terminal)

Next, Table 2 lists the polarities of used toner, the materials used for the intermediate transfer belt 18, the secondary transfer roll 30, and the cleaning blade 32 of the transfer roll cleaner 31, the charge property of the secondary transfer roll among the materials, and the evaluation results of the cleaning evaluation (minimum transfer roll rotation torque when a good cleaning property is obtained) described above for Examples 1 to 3 and Comparative Examples 1 to 3 discussed later.

TABLE 2

| | Intermediate transfer belt | Charge property | Transfer roll | Charge property | Cleaning blade | Toner polarity | Cleaning blade necessary pressure (kgcm) |
|---|---|---|---|---|---|---|---|
| Exp. 1 | PVdF | + | PA | + | PU | + | 0.55 |
| Exp. 2 | PVdF | + | Si | + | PU | + | 0.63 |
| Exp. 3 | PI | − | Teflon | − | PU | − | 0.47 |
| Com. 1 | PVdF | + | PA | + | PU | − | >0.8 |
| Com. 2 | PVdF | + | Si | + | PU | − | 0.75 |
| Com. 3 | PI | − | Teflon | − | PU | + | >0.8 |

(Teflon is a trade name.)

Embodiment 2

Figure 7:
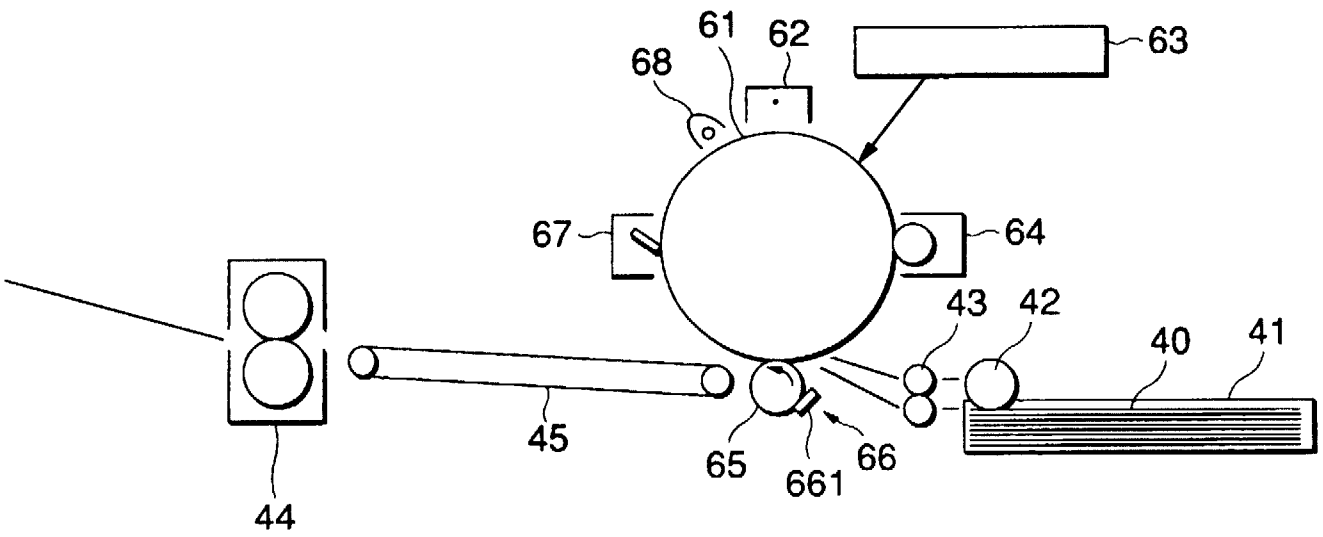
FIG. 7 is an illustration to show a second embodiment of applying the invention to a color image formation system using no intermediate transfer body.

FIG. 7 shows a second embodiment of applying the invention to an image formation system using no intermediate transfer body.

In the figure, numeral 61 is a photosensitive drum, numeral 62 is a charger for charging the photosensitive drum 61, numeral 63 is an exposure unit for forming an electrostatic latent image on the charged photosensitive drum 61, numeral 64 is a developing unit for visualizing the electrostatic latent image formed on the photosensitive drum 61 in predetermined toner, numeral 65 is a transfer roll coming rolling contact with the photosensitive drum 61 for electrostatically transferring the toner image on the photosensitive drum 61 onto transfer paper 40, numeral 66 is a transfer roll cleaner for removing toner adhering to the transfer roll 65, numeral 67 is a cleaner for removing remaining toner on the photosensitive drum 61, and numeral 68 is an electricity removal lamp for removing remaining charges on the photosensitive drum 61.

Numerals 41–45 are components identical with or similar to those previously described with reference to FIG. 2 in the first embodiment.

In the second embodiment, the transfer roll 65 and the transfer roll cleaner 66 are similar to the secondary transfer roll 30 and the transfer roll cleaner 31 in the first embodiment.

Next, Table 3 lists the polarities of used toner, the materials used for the photosensitive drum 61, the transfer roll 65, and a cleaning blade 661 of the transfer roll cleaner 66, the charge property of the transfer roll 65 among the materials, and the evaluation results of the cleaning evaluation (minimum transfer roll rotation torque when a good cleaning property is obtained) described above for Examples 4 to 6 and Comparative Examples 4 to 6 discussed later.

TABLE 3

| | Photosensitive drum | Charge property | Transfer roll | Charge property | Cleaning blade | Toner polarity | Cleaning performance |
|---|---|---|---|---|---|---|---|
| Exp. 4 | PC | + | PA | + | PU | + | O |
| Exp. 5 | PC | + | Si | + | PU | + | Δ |
| Exp. 6 | PC | − | Teflon | − | PU | − | O |
| Com. 4 | PC | + | PA | + | PU | − | X |
| Com. 5 | PC | + | Si | + | PU | − | X |
| Com. 6 | PC | − | Teflon | − | PU | + | X |

(Teflon is a trade name. Under the cleaning performance, O denotes good, Δ denotes normal (small effect), and X denotes NG.)

EXAMPLE 1

PVdF (polyvinylidene fluoride) is used as the intermediate transfer belt 18, PA (polyamide) coat is used as the transfer roll 30, and PU (polyurethane) is used as the cleaning blade 32.

At this time, the charge properties of the transfer roll 30 surface for the intermediate transfer belt 18 and the cleaning blade 32 are both positive and to use positively charged toner, the transfer roll 30 can be cleaned completely at 0.55-kgcm torque.

EXAMPLE 2

PVdF is used as the intermediate transfer belt 18, Si (silicon) coat is used as the transfer roll 30, and PU is used as the cleaning blade 32.

At this time, the charge properties of the transfer roll 30 surface for the intermediate transfer belt 18 and the cleaning blade 32 are both positive. However, since the electrification series of Si is positioned to the negative side as compared with PA in Example 1, the degree of the positive charge property of the transfer roll 30 is smaller than that in Example 1. To use positively charged toner, toner on the surface of the transfer roll 30 can be cleaned completely at 0.63-kgcm torque.

EXAMPLE 3

PI (polyimide) is used as the intermediate transfer belt 18, polytetra fluoroethylene coat is used as the transfer roll 30, and PU is used as the cleaning blade 32.

At this time, the charge properties of the transfer roll 30 surface for the intermediate transfer belt 18 and the cleaning blade 32 are both negative and to use negatively charged toner, toner on the surface of the transfer roll 30 can be cleaned completely at 0.47-kgcm torque.

In the example, paper rear dirty is not observed up to about 7000 sheets of paper at 0.60-kgcm torque.

EXAMPLE 4

PC (polycarbonate) coat is used as the photosensitive drum 61, PA (polyamide) coat is used as the transfer roll 65, and PU is used as the cleaning blade.

At this time, the charge properties of the transfer roll 65 surface for the photosensitive drum 61 and the cleaning blade 661 are both positive and to use positively charged toner, toner on the surface of the transfer roll 65 can be cleaned completely at a predetermined torque.

EXAMPLE 5

PC coat is used as the photosensitive drum 61, Si coat is used as the transfer roll 65, and PU is used as the cleaning blade 661.

At this time, the charge properties of the transfer roll 65 surface for the photosensitive drum 61 and the cleaning blade 661 are both positive. However, since the electrification series of Si is positioned to the negative side as compared with PA in Example 4, the degree of the positive charge property of the transfer roll 65 is smaller than that in Example 4. To use positively charged toner, toner on the surface of the transfer roll 65 can be cleaned completely at a torque slightly larger than that in Example 4.

EXAMPLE 6

PC coat is used as the photosensitive drum 61, polytetra fluoroethylene coat is used as the transfer roll 65, and PU is used as the cleaning blade 661.

At this time, the charge properties of the transfer roll 65 surface for the photosensitive drum 61 and the cleaning blade 661 are both negative and to use negatively charged toner, toner on the surface of the transfer roll 65 can be cleaned completely at a sufficiently low torque.

Comparative Example 1

As the intermediate transfer belt 18, the transfer roll 30, and the cleaning blade 32, those as in Example 1 are used (the charge properties of the transfer roll 30 surface for the intermediate transfer belt 18 and the cleaning blade 32 are both positive), and negatively charged toner is used.

At this time, although the cleaning blade 32 is pressed up to 0.8-kgcm torque, the transfer roll 30 cannot completely be cleaned and paper rear dirt cannot be prevented at the transfer time to the second sheet of paper.

Comparative Example 2

As the intermediate transfer belt 18, the transfer roll 30, and the cleaning blade 32, those as in Example 2 are used, and negatively charged toner is used.

At this time, toner on the surface of the transfer roll 30 can be cleaned only at a large torque of 0.75 kgcm or more.

Comparative Example 3

As the intermediate transfer belt 18, the transfer roll 30, and the cleaning blade 32, those as in Example 3 are used, and positively charged toner is used.

At this time, although the cleaning blade 32 is pressed up to 0.8-kgcm torque, the transfer roll 30 cannot completely be cleaned and paper rear dirt cannot be prevented at the transfer time to the second sheet of paper.

Comparative Example 4

As the photosensitive drum 61, the transfer roll 65, and the cleaning blade 661, those as in Example 4 are used, and positively charged toner is used.

At this time, although the cleaning blade 661 is pressed up to 0.8-kgcm torque, the transfer roll 65 cannot completely be cleaned and paper rear dirt cannot be prevented at the transfer time to the second sheet of paper.

Comparative Example 5

As the photosensitive drum 61, the transfer roll 65, and the cleaning blade 661, those as in Example 5 are used, and negatively charged toner is used.

At this time, toner on the surface of the transfer roll 65 can be cleaned only at a large torque of 0.75 kgcm or more.

Comparative Example 6

As the photosensitive drum 61, the transfer roll 65, and the cleaning blade 661, those as in Example 6 are used, and positively charged toner is used.

At this time, although the cleaning blade 661 is pressed up to 0.8-kgcm torque, the transfer roll 65 cannot completely be cleaned and paper rear dirt cannot be prevented at the transfer time to the second sheet of paper.

As we have discussed, according to the invention, the charge property between the transfer roll and the cleaning member (image support) is set so that the charge property of the transfer roll surface for the cleaning member (image support) coming in contact with the transfer roll becomes the same polarity as toner. Thus, an event wherein the transfer roll is charged to an opposite polarity to toner by frictional electrification with the cleaning member (image support) is eliminated, and electrostatic adhesion of toner to the transfer roll is avoided effectively. Thus, toner adhering to the transfer roll can be removed easily and reliably without imposing such a load interfering with rotation of the transfer roll.

Particularly, if the charge properties between the transfer roll and the cleaning member and between the transfer roll and the image support are set so that both the charge polarity of the transfer roll surface for the cleaning member coming in contact with the transfer roll and that for the image support coming in contact with the transfer roll become the same polarity as toner, an event wherein the transfer roll is charged to an opposite polarity to toner by frictional electrification with the cleaning member and the image support is eliminated reliably, and electrostatic adhesion of toner to the transfer roll is avoided more reliably. Thus, the effect of being capable of removing toner adhering to the transfer roll easily and reliably without imposing such a load interfering with rotation of the transfer roll can be produced in the best form.

What is claimed is:

1. A transfer apparatus for electrostatically transferring a toner image of a given polarity supported on an image support to a recording medium, said apparatus comprising:

a transfer roll coming in rolling contact with said image support in synchronization therewith and having a transfer electric field of an opposite polarity to toner formed in a gap between said transfer roll and said image support; and a cleaning member abutting said transfer roll for removing residues on said transfer roll, wherein a voltage is not directly applied to said cleaning member, and wherein a charge property of a contact surface portion between said cleaning member and said transfer roll is set so that a charge polarity on a surface of said transfer roll produced as said cleaning member abuts said transfer roll becomes the same as a toner polarity on said image support.

2. The transfer apparatus of claim 1, wherein the surface portion of said image support and the surface portion of said transfer roll are made of the same material.

3. The transfer apparatus of claim 1, wherein said cleaning member is pivotally mounted.

4. The transfer apparatus of claim 3, wherein said pivotally mounted cleaning member varies a pressing force of the cleaning member against the transfer roll.

5. The transfer apparatus of claim 4, wherein said pressing force is a minimum of 0.5 grams per unit length.

6. The transfer apparatus of claim 4, wherein said pressing force is a maximum of 3.0 grams per unit length.

7. The transfer apparatus of claim 4, wherein said pressing force is at least 0.5 and not greater than 3.0 grams per unit length.

8. A transfer apparatus for electrostatically transferring a toner image of a given polarity supported on an image support to a recording medium, said apparatus comprising:

a transfer roll coming in rolling contact with said image support in synchronization therewith and having a transfer electric field of an opposite polarity to toner formed in a gap between said transfer roll and said image support; and a cleaning member abutting said transfer roll for removing residues on said transfer roll, wherein a voltage is not directly applied to said cleaning member, and wherein a charge property of a contact surface portion between said image support and said transfer roll is set so that a charge polarity on a surface of said transfer roll produced as said image support abuts said transfer roll becomes the same as a toner polarity on said image support.

9. The transfer apparatus of claim 8, wherein said cleaning member is pivotally mounted.

10. The transfer apparatus of claim 9, wherein said pivotally mounted cleaning member varies a pressing force of the cleaning member against the transfer roll.

11. The transfer apparatus of claim 10, wherein said pressing force is a minimum of 0.5 grams per unit length.

12. The transfer apparatus of claim 10, wherein said pressing force is a maximum of 3.0 grams per unit length.

13. The transfer apparatus of claim 10, wherein said pressing force is at least 0.5 and not greater than 3.0 grams per unit length.

14. A transfer apparatus for electrostatically transferring a toner image of a given polarity supported on an image support to a recording medium, said apparatus comprising:

a transfer roll coming in rolling contact with said image support in synchronization therewith and having a transfer electric field of an opposite polarity to toner formed in a gap between said transfer roll and said image support; and a cleaning member abutting said transfer roll for removing residues on said transfer roll, wherein a voltage is not directly applied to said cleaning member, and wherein a charge property between said transfer roll and said cleaning member and that between said transfer roll and said image support are set so that both a charge polarity on a surface of said transfer roll produced as said cleaning member abuts said transfer roll and a charge polarity on a surface of said transfer roll produced as said image support abuts said transfer roll become the same as a toner polarity on said image support.

15. The transfer apparatus of claim 14, wherein said cleaning member is pivotally mounted.

16. The transfer apparatus of claim 15, wherein said pivotally mounted cleaning member varies a pressing force of the cleaning member against the transfer roll.

17. The transfer apparatus of claim 16, wherein said pressing force is a minimum of 0.5 grams per unit length.

18. The transfer apparatus of claim 16, wherein said pressing force is a maximum of 3.0 grams per unit length.

19. The transfer apparatus of claims 16, wherein the pressing force is at least 0.5 and not greater than 3.0 grams per unit length.

20. A transfer apparatus for electrostatically transferring a toner image of a given polarity supported on an image support to a recording medium, said apparatus comprising:

a transfer roll coming in rolling contact with said image support in synchronization therewith and having a transfer electric field of an opposite polarity to toner formed in a gap between said transfer roll and said image support: and a cleaning member abutting said transfer roll for removing residues on said transfer roll, wherein a charge property between said transfer roll and said cleaning member and that between said transfer roll and said image support are set so that both a charge polarity on a surface of said transfer roll produced as said cleaning member abuts said transfer roll and a charge polarity on a surface of said transfer roll produced as said image support abuts said transfer roll become the same as a toner polarity on said image support, wherein the surface of said transfer roll is made of polytetra flouroethylene, the surface of said cleaning member is made of polyurethane, and the surface of said image support is made of polymide in the type wherein the toner image on said image support has a negative polarity.

* * * * *